US005489320A

United States Patent [19]

Nied

[11] Patent Number: 5,489,320

[45] Date of Patent: Feb. 6, 1996

[54] AIR SEPARATOR

[76] Inventor: Roland Nied, Raiffeisen-Strasse 10, 86486 Bonstetten, Germany

[21] Appl. No.: 296,254

[22] Filed: Aug. 25, 1994

[30] Foreign Application Priority Data

Sep. 2, 1993 [DE] Germany ..... 43 29 706.4

[51] Int. Cl.[6] ..... B07B 7/00

[52] U.S. Cl. ..... 55/408; 55/438; 55/457; 55/460

[58] Field of Search ..... 55/408, 438, 456, 55/457, 460

[56] References Cited

U.S. PATENT DOCUMENTS

| | | | |
|---|---|---|---|
| 2,591,408 | 4/1952 | Crankshaw | 55/438 |
| 2,738,855 | 3/1956 | Fallon et al. | 55/438 |
| 2,989,146 | 6/1961 | Lundy | 55/408 |
| 3,406,504 | 10/1968 | Sylvan | 55/438 |

FOREIGN PATENT DOCUMENTS 9309883 5/1993 WIPO .

*Primary Examiner*—C. Scott Bushey
*Attorney, Agent, or Firm*—Levine & Mandelbaum

[57] ABSTRACT

The present invention pertains to an air separator with a stationary housing, which forms a helix when viewed in the axial direction, with a blade ring arranged stationarily in the housing with adjustable blades, and with a bladed separation wheel, which is arranged coaxially within the blade ring and rotatable around the axis of the housing. A raw material inlet opens tangentially into the annular space between the separation wheel and the blade ring, and the separation gas inlet, which is directed in parallel to the crude gas inlet, opens into the annular space between the blade ring and the helical housing. Finally, a raw material outlet is provided in the end zone of the flow in the annular space between the blade ring and the separation wheel. A coarse material outlet is arranged offset in relation to the separation gas outlet in the axial direction of the helical housing, as a result of which the helical housing has the three-dimensional shape of a worm with at least one revolution.

2 Claims, 2 Drawing Sheets

AIR SEPARATOR

BACKGROUND OF THE INVENTION

The present invention is based on an air separator with the features of the air separators according to WO 93/09883 of the same applicant and also according to German Offenlegungsschrift No. DE-OS 24,26,295. The separator housing is helical in both cases and in the case of the present invention, the separator housing has a tangential separation air inlet, an inlet for the material to be separated parallel to the separation air inlet, as well as an axial fine material outlet. The fine material outlet is preceded by a separation wheel, through which the material to be separated is blown radially from the outside to the inside, and from which the separation air mixed with fine material is discharged axially, is removed from the separator housing through the separated material outlet and is fed to, e.g., a filter. After tangential entry into the separator housing, the material to be separated rotates around the axis of the separation wheel on a helical path, the coarse material enters the area of the helical flow located radially on the outside, it is separated from the mixture of separation air and fine material, and leaves the separator housing through a coarse material outlet.

In both cases, after tangentially entering the separator housing, the separation air first enters the flow channels of a blade ring with adjustable blades before mixing with the material to be separated takes place. While having the same design, the two blade rings are completely different due to the completely different tasks. In the case of the air separator according to DE-OS 24,26,295, the blade ring is the actual separation means, i.e., the separation of the particle containing gas flow, of the "material to be separated" into the fine material component, on the one hand, and into the coarse material component, on the other hand, takes place in the blade ring. Thus, the separation wheel is only an additional component. Based on the consideration that during of separation, the fine material can be contaminated with spray particles, which are formed after collision with other particles or after rebounding from the coarse material outlet, in the blade ring. The purpose of the separation wheel is to prevent these spray particles from entering the fine material outlet, and the separation wheel is therefore operated at a cut point which is above the coarsest cut point that can be set with the helical air separator, i.e., above the cut point that can be set with the stationary blade ring.

The conditions are fundamentally different in the air separator according to WO 93/09883. The separation takes place in the separation wheel in the air separator described there. While the separation into fine material and coarse material takes place in the stationary blade ring in the first air separator discussed above, the separation into fine material and coarse material takes place in the separation wheel, i.e., in the rotating blade ring, in the air separator according to WO 93/09883. While a rotating blade ring is an additional component, which has a special function in terms of catching spray particles, in the first air separator, the stationary blade ring is an additional component in the second air separator, and this blade ring has a special function, which consists of ensuring uniform conditions for the separation air over the entire circumference of the separation wheel. The blades of the stationary blade ring are therefore designed, arranged and adjustable such that due to the adjustment of the blades of the stationary blade ring in the annular space between the blade ring and the separation wheel, a helical air separation can be achieved. This provides a coarser separation size than would correspond to the conditions prevailing at the outer edges of the blades of the separation wheel. Consequently, spray particles are caught in one case, and the flow conditions at the outlet of the blade channels of the separation wheel are changed in the other case.

Regardless of this fundamental difference, the above-mentioned two air separators also differ by a different design of the coarse material discharge. In both cases, a separation air component is located radially on the outside and receives coarse material, which is peeled off with an edge. The coarse material is discharged with a screw arranged downstream of the edge in the case of the separator according to DE-OS 24,26,295. In contrast, the coarse material is peeled off by a properly arranged baffle plate in the case of the separator according to WO 93/09883. The baffle plate and especially the screw are additional components, which not only cause higher costs and additional weight, but are also subject to wear. In recognizing this circumstance, the basic task of the present invention is to design an air separator with the features according to the prior art discussed above but with neither a baffle plate nor a screw being necessary for discharging the coarse material.

SUMMARY OF THE INVENTION

The present ivnentin includes an air separator with a stationary housing forming a helix when viewed in the axial direction, with a blade ring arranged stationarily in the housing with adjustable blades, and with a bladed separation wheel, which is arranged coaxially within the blade ring and rotates around the axis of the housing, as well as with a particle-containing gas inlet opening tangentially into the annular space between the separation wheel and the blade ring and with a separation gas inlet, which is directed in parallel to the particle containing gas inlet and opens into the annular space between the blade ring and the helical housing, and, finally, with a coarse material outlet in the end zone of the flow in the annular space between the blade ring and the separation wheel. The helical housing has, as a result, the three-dimensional shape of a worm with at least one complete revolution.

The separation wheel (7) and the helical blade ring are associated with one another such that the blades of the separation wheel cover, as extensively as possible the blades of the blade ring in both the inlet area and the outlet area of the separator housing.

A coarse material outlet (8) is arranged offset in the axial direction of the helical housing in relation to the separation gas inlet (5) and the inlet (3) for the material to be separated.

The present invention will be explained in greater detail below based on the drawings, with reference to an air separator typified by WO 93/09883, in which a separation wheel is the actual separation means, and the separation wheel is preceded by a blade ring, which ensures that identical flow conditions prevail for the separation air over the entire circumference of the separation wheel. The blades of the separation wheel should consequently be arranged and designed such that helical air separation, which ensures a coarser separation size than would correspond to the conditions prevailing at the outer edges of the blade wheel which acts as a separation wheel, can be achieved by adjusting the blades of the blade ring in the annular space between the blade ring and the blade wheel acting as a separation wheel.

Even though such a separator design is a preferred design for the present invention, the separator design may also be based on DE-OS 24,26,295, in which the actual separation element is a stationary blade ring, and a separation wheel is arranged in this separation element only to catch spray particles, i.e., the blade wheel separator is operated at a cut point that is above the coarsest separation size that can be set with the helical air separator.

DESCRIPTION OF THE PREFERRED EMBODIMENT

Figure 1:
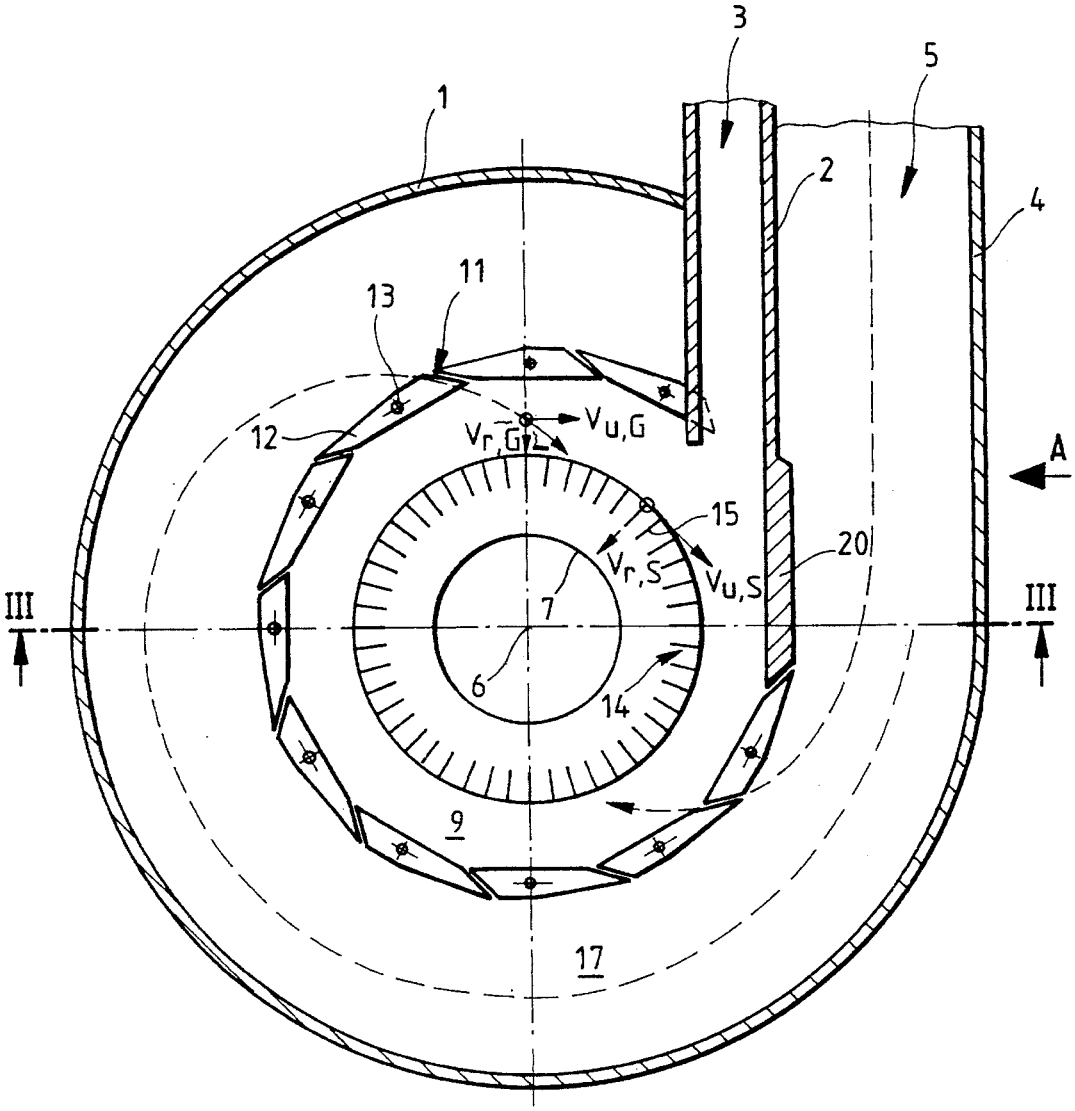
FIG. 1 shows a vertical central longitudinal section through an air separator designed and operating according to the present invention.

The separation chamber 9 is surrounded by a stationary blade ring 11. The guide blades 12 of the blade ring 11 are individually adjustable around their respective longitudinal axis 13. The blade ring 11 forms part of a circle that is concentric to the separator axis 6.

A known, rotary separation wheel 14, which has blades 15, is arranged in the separation chamber 9 surrounded by the blade ring 11, likewise concentric to the separator axis 6. The annular space between the outer circle of the separation wheel 14 and the inner circle of the blade ring 11 is relatively narrow, because no separation is to take place in it. The width of the annular space between the separation wheel and the blade ring is selected to be only such as is necessary with respect to the ordered passage of the raw material consisting of the material to be separated and separation air, the latter from the blade ring, into the separation wheel.

The inlet 3 for the material to be separated opens tangentially into the separation chamber 9 in the area of the annular space between the blade ring 11 and the separation wheel 14. The separation air inlet 5 opens tangentially into the annular space 17 between the blade ring 11 and the housing, which is helical in the representation in FIG. 1. The inlet 3 for the material to be separated and the separation air inlet 5 are pipes arranged in parallel to one another. The coarse material outlet is a pipe, which is located opposite the separation air inlet 5 and the product inlet 3 in the representation in FIG. 1, i.e., it is directed downward, and the two inlets 3, 5, on the one hand, and the coarse material outlet 8, on the other hand, are offset in relation to one another by at least one screw turn in the direction of the longitudinal axis of the separator or the axis of rotation of the separation wheel 14, i.e., the housing is a worm housing, which also appears from the representations in FIGS. 2 and 3. It can also be recognized from FIG. 2 that the blading of the separation wheel extensively covers the blades of the blade ring 11 in both the inlet area 3, 5 and the outlet area 8.

The separation air flows through the flow channels between the guide blades 12 of the blade ring 11 from the outside to the inside. The guide blades 12 are located on a helical contour defined by the housing and are mounted rotatably in the housing 1 such that both the angle at which the separation gas flows in and the gap width between the blades 12 can be varied. The material to be separated is charged in on the inside of the guide blades 12 of the blade ring 11, and the separation gas flows through it intensely. Based on the prevailing flow conditions caused by the blade position and the shape of the blades, turbulence develops in the flow channels between the blades of the blade ring 11, and this turbulence prevents material to be separated from settling on the guide blades, and, finally, a three-dimensional helical or spiral flow develops in the separation chamber 9.

The same physical conditions prevail in the separation wheel 14 with the blades 15, which is arranged concentrically in the separation chamber 9, but the radial and circumferential velocities are influenced here by the mass flow and the speed of rotation of the separation wheel 14, rather than by the mass flow and the blade position. To ensure that the fineness is determined mainly by the separation wheel 14, the cut point is set higher in the annular intermediate space than at the separation wheel 14.

The outer blade ring 11 is used for only a relatively slight pre-separation, but especially for intensely dispersing and disintegrating of the material being separated. The separation proper takes place at high efficiency in the separation wheel.

The fine material finally leaves the separator via the fine material outlet 7 of the separation wheel 14; dispersed material, which circulates close to the blade ring 11, is thus preferably removed from the separation chamber via the coarse material outlet 8. Due to the offset of the material inlet 3 and the separation air inlet 5, on the one hand, and the coarse and dispersed material outlet 8, on the other hand, in the axial direction of the housing, the coarse material and, if present, dispersed material reach the area of the coarse material outlet 8 along the inside of the housing wall without the need for special additional built-in components, such as a baffle plate or a discharge screw.

Figure 2:
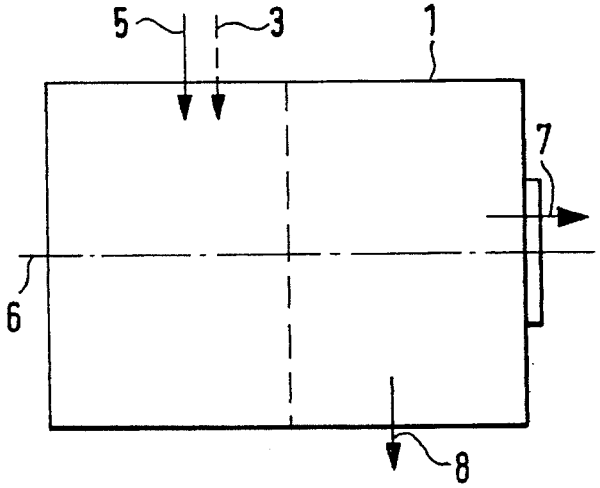
FIG. 2 shows a view of the separator housing in the direction of arrow A in FIG. 1.
Figure 3:
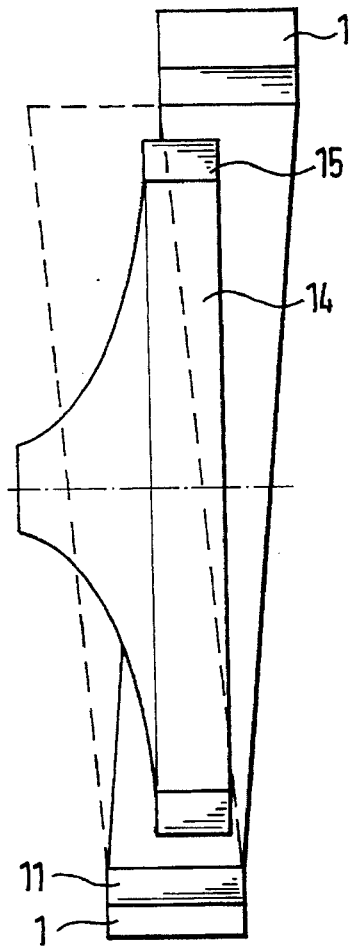
FIG. 3 shows a section according to line III—III in FIG. 1. It should be mentioned in connection with FIG. 1 that the separator may also be arranged horizontally, so that FIG. 1 is a horizontal central longitudinal section.

The air separator according to the present invention is shown in FIG. 2 with the view of the separator housing 1 being in the direction indicated by the arrow A in FIG. 1. It shows how the product inlet or the inlet for the material to be separated, 3, and the separation air inlet 5, lying one behind the other in this view, are offset in relation to one another by one screw turn in the direction of the separator axis 6 and are associated with the separator housing 1 pointing upward (said inlets 3 and 5) and downward (said coarse material outlet 8).

The guide blades 12 of the outer, static blade ring 11 are set such that the angle of flow through the guide blades 12 and the cross sections of the guide blade channels between the guide blades in the annular separation chamber 9 between the blade ring 11 and the blade-type separation wheel 14 bring about helical air separation, which ensures a coarser separation size than would correspond to the conditions prevailing at the outer edge of the blade-type separation wheel. The forces acting on the material being separated during the operation of the separator are indicated by arrows in FIG. 1.

Since no separation is to take place in the annular space 17, this annular space may have a constant width, even though it may also become narrower in the direction of flow.

I claim:

1. An air separator comprising a helical housing extending in an axial direction along a central longitudinal axis with at least one complete revolution with respect to said central longitudinal axis, said housing having an outer wall with an inlet section and an outlet section, a blade ring fixedly mounted in the housing, said blade ring having adjustable blades, a bladed separation wheel mounted coaxially within and in spaced relationship to the blade ring, and rotatehie around the axis of the housing, particle-containing gas inlet means mounted on said housing inlet section and opening tangentially into an annular space between the separation wheel and the blade ring, separation gas inlet moon mounted on said housing inlet section in parallel with the particle-containing gas inlet means and opening into an annular space between the blade ring and the helical housing outer wall, and coarse material outlet means mounted on said housing outlet section and opening into the space between the blade ring and the separation wheel, the coarse material outlet means being offset from the particle-containing gas inlet means and separation gas inlet means in the axial direction of the helical housing.

2. An air separator in accordance with claim 1 wherein the blade ring is helical and the blades of the separation wheel cover the blades of the blade ring as extensively as possible in both the inlet section and the outlet section of the housing.

* * * * *